US007901541B2

(12) United States Patent
Snekkenes et al.

(10) Patent No.: US 7,901,541 B2
(45) Date of Patent: Mar. 8, 2011

(54) METHOD AND ARRANGEMENT FOR IMPREGNATING CHIPS

(75) Inventors: Vidar Snekkenes, Karlstad (SE); Lennart Gustavsson, Karlstad (SE); Daniel Trolin, Karlstad (SE); Mats Nasman, Karlstad (SE)

(73) Assignee: Metso Fiber Karlstad AB, Karlstad (SE)

( * ) Notice: Subject to any disclaimer, the term of this patent is extended or adjusted under 35 U.S.C. 154(b) by 807 days.

(21) Appl. No.: 11/572,106

(22) PCT Filed: Jul. 14, 2005

(86) PCT No.: PCT/SE2005/001162

§ 371 (c)(1), (2), (4) Date: Aug. 1, 2007

(87) PCT Pub. No.: WO2006/006934

PCT Pub. Date: Jan. 19, 2006

(65) Prior Publication Data

US 2008/0093041 A1 Apr. 24, 2008

(30) Foreign Application Priority Data

Jul. 15, 2004 (SE) ..... 0401870

(51) Int. Cl.
*D21C 1/00* (2006.01)

(52) U.S. Cl. ..... 162/17; 162/29; 162/63

(58) Field of Classification Search ..... 162/17, 162/29, 63

See application file for complete search history.

(56) References Cited

U.S. PATENT DOCUMENTS

| | | | | |
|---|---|---|---|---|
| 2,803,540 | A | 8/1957 | Durant | |
| 3,532,594 | A | 10/1970 | Richter | |
| 5,635,025 | A | 6/1997 | Bilodeau | |
| 6,280,567 | B1 | 8/2001 | Gustavsson | |
| 2004/0060672 | A1 * | 4/2004 | Snekkenes et al. | 162/19 |
| 2005/0061458 | A1 * | 3/2005 | Snekkenes et al. | 162/19 |

FOREIGN PATENT DOCUMENTS

| | | |
|---|---|---|
| DE | 1261387 | 2/1968 |
| SE | 523850 | 5/2004 |
| WO | WO 03/106765 | * 12/2003 |
| WO | WO03106765 | 12/2003 |

* cited by examiner

*Primary Examiner* — Matthew J Daniels
*Assistant Examiner* — Dennis Cordray
(74) *Attorney, Agent, or Firm* — Rolf Fasth; Fasth Law Offices

(57) ABSTRACT

The method is for the impregnation of chips during the manufacture of chemical pulp. The chips are continuously fed without preceding steam treatment to the top of an impregnation vessel that maintains atmospheric pressure. Impregnation fluid (BL) is added to the impregnation vessel and establishes a fluid level (LIQ_LEV). The chips that have been added establish a chips level (CH_LEV) that lies at least 3-5 meters over the fluid level. The temperature at the top of the vessel essentially corresponds to ambient temperature.

Impregnation fluid BL is fed in to the impregnation vessel in such an amount and at such a temperature that the temperature that is established at the fluid level (LIQ_LEV) is established within the interval 90-115° C., preferably within the interval 95-105° C.

12 Claims, 1 Drawing Sheet

METHOD AND ARRANGEMENT FOR IMPREGNATING CHIPS

PRIOR APPLICATION

This application is a U.S. national phase application based on International Application No. PCT/SE2005/001162, filed 14 Jul. 2005, claiming priority from Swedish Patent Application No. 0401870-1, filed 15 Jul. 2004.

TECHNICAL AREA

The present invention relates to a method for impregnating chips.

THE PRIOR ART

A pre-treatment arrangement with a chip bin has been used during conventional manufacture of chemical cellulose pulp in continuous digesters, in which a first heating of the chips by steam to a temperature of 70-80° C. is preferably carried out. A steam-treatment vessel follows the pre-treatment in which the chips are intensely heated with steam to 110-120° C., followed by an impregnating chip chute before the cooking process is established in the digester. This process requires large quantities of steam, not only in the chip bin but also in the steam-treatment vessel.

Steam treatment in one or several steps has been used in the chip bin and before the subsequent formation of a slurry of the chips with an impregnation fluid or a transport fluid, as has been mentioned above. The steam treatment has been considered to be totally necessary in order to be able ensure that air and water bound to the chips are expelled, such that the impregnation fluid can fully penetrate the chips and such that air is not drawn into the digestion process with the chips.

Attempts have been made to integrate the chip bin with the impregnation vessel such that a simple system is in this way obtained.

U.S. Pat. No. 3,532,594 shows a combined vessel in which steam treatment and the formation of a slurry take place in a single pressure vessel that is maintained at an excess pressure of 1-2 atmospheres. The system was used in a pulp plant in Sweden as early as the 1970s. In this case, an impregnation fluid is recirculated during the addition of black liquor that maintains the suggested temperature of 105° C. in a circulation that consists of withdrawal strainer (35)—pump (23)—heat exchanger (25)—outlet/central pipe (19). The idea in this case was that all water vapour would be expelled through the superior bed of chips by steam, and that this water vapour could be withdrawn (ventilated) through the outlet 12. A powerful heat exchanger (25) was required in this system. There is a serious risk of malodorous non-condensable gases (NCGs) leaking out, via the inlet 13. It is also specified in this patent that it would be possible to remove totally the addition of steam and have only a reinforced indirect heating of the chips with the aid of a heating flow during the addition of black liquor. It is difficult to implement this heating technology since it requires very large recirculation flows and a large heating power in the heat exchanger in order to be able to heat the cold chips.

U.S. Pat. No. 5,635,025 shows a system in which chips are fed without a preceding steam treatment into a vessel in the form of a combined chip bin, impregnation vessel and chip chute. Steam treatment of the chips that lie above the fluid level takes place at this location by the addition of steam from a "steam source", as does a simple addition of impregnation fluid in the lower part of the vessel.

U.S. Pat. No. 6,280,567 shows a further such system in which the chips are fed without preceding steam treatment into an impregnation vessel at atmospheric pressure where the chips are heated by the addition of hot black liquor that maintains a temperature of approximately 130-140° C. The hot black liquor is added just under the fluid level and its pressure is reduced upwards through the bed of chips, after which malodorous expelled gases are ventilated away from the top of the vessel. This generates large quantities of malodorous gases, and these must be processed and destroyed in special systems.

SE 523850 shows an alternative system in which hot, pressurised black liquor taken directly from the digester at a temperature of 125-140° C. is added to the upper part of the steam-treatment vessel, above the fluid level but under the level of chips, whereby the black liquor whose pressure has been relieved releases large quantities of steam for the steam treatment of the chips that lie above the fluid level established in the vessel. A temperature between 140-160° C. is established in the impregnation vessel in this system. Excess fluid, the black liquor, can in this case be withdrawn from the lower part of the vessel.

Thus, prior art technology has in most cases used steam treatment as a significant part of the heating of the chips, where the steam that is used is either constituted by newly generated steam or by steam that has been obtained following pressure reduction of black liquor from the cooking step. This ensures a relatively large flow of steam, with the associated consumption of energy, and it requires a steam-treatment system that can be controlled. The steam treatment has also involved the generation of large quantities of malodorous gases, and their generation with a high risk of explosion at certain concentrations.

WO03106765 shows an arrangement in an attempt to avoid the problems described above that are associated with these solutions. Impregnation fluids (BL1/BL2/BL3) are in this case added with increasing temperatures at different positions (P1, P2, P3), and the establishment of a zone (Z1) of countercurrent flow at the uppermost part of the impregnation vessel. The need for steam treatment can in this way be reduced while the amount of expelled weak gases can at the same time be eliminated. Most of the volatile compounds in the wood are bound to the withdrawn impregnation fluid (REC). It is true that it is in this case suggested that the flow upstream towards the withdrawal strainer is to be adapted such that the temperature of the withdrawn material can be maintained at the low value of 30° C. and that it is in this way possible to avoid evaporation up in the bed of chips. This method of operation is well-suited for certain types of wood with a high density (certain eucalyptus woods) and where there is a high level of the superior bed of chips. However, it is difficult under certain operating conditions (type of wood and the height of the superior column of chips) for the chips to sink when the temperature at the fluid level is far too low for the chips to be able to sink in the impregnation fluid.

AIM AND PURPOSE OF THE INVENTION

It has surprisingly become apparent that the use of an intense steam treatment of the chips in one or several steps with the use of at least one of pressure vessels and forced ventilation of steam through the complete bed of chips used in prior art technology is not necessarily required. The requirement for steam treatment during established stable operation can, in contrast, be limited to the limited zone of the bed of chips that lies above the fluid level in the impregnation vessel. A fully adequate steam treatment is achieved in combination with a pre-determined height of the bed of chips above the fluid level and the limited steam treatment that allows the chips to sink in the impregnation fluid, even when using types of wood with a lower density or when using systems with a lower level of the superior column of chips and where an even motion of the column of chips without disturbance is established in the impregnation vessel. The limited steam treatment of the invention allows the implementation of what is known as "cold-top" regulation in the impregnation vessel, which means that the upper surface of the bed of chips maintains what is essentially normal ambient temperature, 15-25° C., and that this does not involve the steam continuously expelling non-condensable gases (NCGs) through the bed of chips, which gases otherwise require extraction systems for these harmful and malodorous gases.

The principal aim of the present invention is to achieve an improved method and an improved arrangement for the impregnation and heating of chips that have not been steam-treated, which method and arrangement do not display the disadvantages that are associated with other known solutions specified in the description of prior art technology.

A second aim is to ensure that the chips sink in the impregnation fluid.

A third aim is to add impregnation fluid to the impregnation vessel in such a quantity and at such a temperature that the temperature that is established at the fluid level is established in the interval 90-115° C., preferably in the interval 95-105° C.

A fourth aim is to be able to use a simpler vessel at atmospheric pressure for the impregnation, which would thus not require pressure certification, and in this way reduce the investment costs.

A further aim is to reduce to an absolute minimum the quantities of additional steam that are required.

A further aim is to reduce to a minimum the amounts of expelled NCGs and malodorous gases and in this way to reduce the need of or to significantly reduce the capacity of a weak gas management system.

A further aim with one preferred embodiment is that with the high temperature at the fluid level combined with a withdrawal of fluid at the level of the fluid level it is possible to achieve a controlled evaporation a short distance up in the column of chips that lies above the fluid level, and in this way to expel volatile compounds from the chips. An equilibrium condition will be achieved when operation has been established, in which condensate from the limited zone of evaporation will be withdrawn though the withdrawal strainer arranged at the level of the fluid.

BRIEF DESCRIPTION OF THE INVENTION

The invention is based on the surprising insight that it is the temperature at the surface of the impregnation fluid in the impregnation vessel that determines whether the chips in an impregnation vessel can manage to sink in the impregnation fluid. It has surprisingly turned out to be the case that if the temperature at the fluid surface lies within a narrow range of temperature, the air in the chip fragments will be expelled to an extent that is fully sufficient for the chips subsequently to be able to sink in the impregnation vessel. A lighter and a simpler form of a local steam treatment for a very limited quantity of chips in the column of chips that lies above the fluid surface and in direct connection with the fluid surface is sufficient to achieve the steam treatment that makes it possible for the column of chips to sink.

This is achieved according to the invention by adding impregnation fluid in connection with the fluid surface ±1 meter at such a quantity and at such a temperature that the temperature that is established at the fluid surface lies within the interval 90-115° C., preferably 95-105° C.

According to the prior art technology described above, the problem of chips floating in the impregnation vessel has been solved by severe steam treatment of the chips in the chip bin and the subsequent steam-treatment vessel. This method requires very large volumes of steam and it produces enormous quantities of NCGs that must be managed in expensive weak-gas systems.

DETAILED DESCRIPTION OF THE INVENTION

Figure 1:
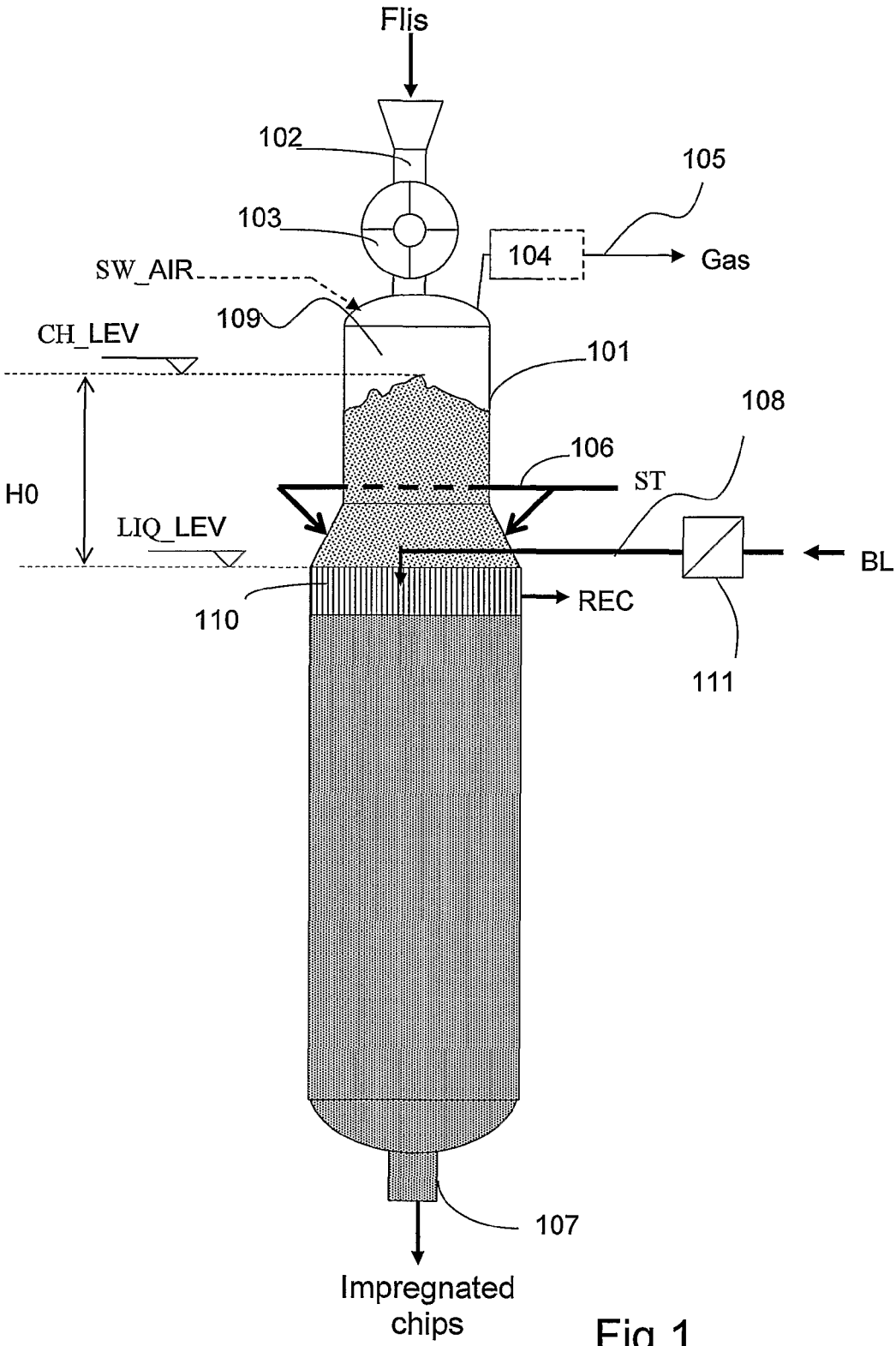
FIG. 1 shows an arrangement for impregnation of chips during the manufacture of chemical pulp according to the invention.

The concept "untreated chips" will be used in the following detailed description. "Untreated chips" is here used to denote chips that have not passed through any form of pre-treatment by, for example, steam treatment or similar, before the chips are fed into an impregnation vessel to be impregnated.

The concepts "fluid level, LIQ_LEV" and "chips level, CH_LEV" will also be used. The term "fluid level, LIQ_LEV" is here used to denote the level that the impregnation fluid BL added to the impregnation vessel 101 has established in the vessel. The term "chips level, CH_LEV" is here used to denote the height of that part of the bed of chips (consisting of chips) that is located above the fluid level, LIQ_LEV.

FIG. 1 shows an arrangement for the impregnation of chips during the manufacture of chemical pulp. The arrangement comprises an essentially cylindrical impregnation vessel 101 arranged vertically, to which untreated chips/non-steamed chips are continuously fed to the top of the impregnation vessel through a feed arrangement, in the form of a small chip bin 102 without steam treatment, and a sluice feed/chip feed 103. The temperature at the top 109 of the vessel essentially corresponds to ambient temperature, 15-25° C., where steam ST may be added if the ambient temperature falls below normal ambient temperature and in such a quantity that a chip temperature within this interval is established. The chips that are fed to the impregnation vessel normally maintain the same temperature as the ambient air temperature ±5° C. The chips fed in establish a chips level CH_LEV in the upper part of the impregnation vessel.

According to the invention, a feed line 108 with impregnation fluid BL is connected to the impregnation vessel in order to establish a fluid level LIQ-LEV consisting of the said impregnation fluid. The impregnation fluid is fed directly in in association with the fluid level LIQ_LEV+−1 meter. The impregnation fluid BL is added at the center of the cross-section of the impregnation vessel and is fed in to the impregnation vessel in such an amount and at such a temperature that the temperature at the fluid level CH_LEV is established within the interval 90-115° C. and preferably within the interval 95-105° C., whereby evaporation of fluid takes place up into the superior bed of chips locally above the fluid level, while at the same time steam is not driven through the superior bed of chips. The evaporation up into the superior bed of chips takes place over a distance that does not exceed half of the height of the superior chips level CH_LEV, it is preferable that the evaporation takes place up into the superior bed of chips over a distance that does not exceed 25% of the superior chips level CH_LEV.

The impregnation fluid BL added is constituted to more than 50% by cooking fluid after use in a cooking zone in a subsequent digester, which impregnation fluid BL has an alkali level of at least 15 g/l. The amount of impregnation fluid BL that is added to the vessel 101 lies between 5-10 m3/ADT, preferably between 7-9 m3/ADT, where "ADT" is an abbreviation for "Air-dry tonne" of pulp. In other words, at least 5 tonnes of the impregnation fluid BL is added per tonne of chips.

The temperature of the impregnation fluid BL in the feed line 108 maintains a temperature of 115-150° C. and the chips level CHJ-EV lies at least 1-2 meters over the fluid level and preferably 3-5 meters over the fluid level LIQ_LEV, in order to facilitate the sinking of the chips in the impregnation fluid, where the chips are heated. In order to ensure that the temperature of the added impregnation fluid BL is not exceeded, a cooling means 111 may be preferably arranged in front of the impregnation vessel 101. The cooling means may be an indirect heat exchanger, a pressure-reduction cyclone or other evaporative cooling, or it may be the addition of cold fluid, preferably colder process fluids, alkali or washing filtrate. A portion of the impregnation fluid may be cooled in a cooler. Also, a portion of the impregnation fluid may be heated in a heater.

Given non-steam treated chips that maintain 25° C. with their naturally occurring moisture level, 5 tonnes of fluid that maintains 139° C. are required in order to establish a temperature of approximately 115° C. in the chips mixture at the fluid level.

If a temperature of 100° C. is to be established in the chips mixture, given the same basic conditions, 5 tonnes of impregnation fluid that maintains 120° C. is required.

By adding the impregnation fluid in association with the fluid level CH_LEV, the air present in the chips will be flashed out, and the chips will sink in the impregnation fluid.

A withdrawal strainer 110 can, in one preferred embodiment, be used in order to withdraw impregnation fluid REC from the impregnation vessel 101, at the level of the fluid level LIQ_LEV.

In one preferred embodiment, the temperature of the material REC withdrawn is measured, and in this case either one of the temperature and the amount of added impregnation fluid BL is adjusted such that the target value desired for the withdrawn material REC is maintained.

The pressure in the vessel can be adjusted as required through a regulator valve 104 arranged in a ventilation line 105 at the top of the impregnation vessel. The ventilation line 105 may open directly into the atmosphere, for the establishment of atmospheric pressure. A pressure is established within the top of the impregnation vessel that is essentially at atmospheric pressure ±0.5 bar. It is preferable that a pressure at a level of atmospheric pressure is established, or a slight negative pressure down to −0.2 bar (−20 kPa), or a slight excess pressure up to 0.2 bar (20 kPa). If necessary, an addition of a ventilating flow SW_AIR (sweep air) may be added at the top, which ventilating flow ensures the removal of any gases. However, this is not to be normally necessary during established operation. The impregnated chips are continuously fed out through output means, here in the form of an outlet 107, combined where relevant with a bottom scraper (not shown in the drawing), at the bottom of the impregnation vessel 101.

The impregnated chips are

The following advantages are achieved with the invention:

The chips sink in the impregnation fluid, and there is no risk that they float.

The quantity of steam added is lower.

The quantities of NCGs and malodorous gases expelled are minimal.

The invention is not limited to the embodiments shown. Several variants are possible within the framework of the claims.

While the present invention has been described in accordance with preferred compositions and embodiments, it is to be understood that certain substitutions and alterations may be made thereto without departing from the spirit and scope of the following claims.

The invention claimed is:

1. A method for the impregnation of chips during the manufacture of chemical pulp, comprising:

continuously feeding chips, without a preceding steam treatment, to a top of an impregnation vessel, the chips establishing a chips level, feeding at least 5 tonnes of an impregnation fluid per tonne of chips into the impregnation vessel, the impregnation fluid establishing a fluid level, the chips level being at least 1-2 meters above the fluid level, the impregnation fluid having a temperature in an interval of 115-150° C. and an alkali level exceeding 15g/l, establishing a pressure within the top of the impregnation vessel that is essentially at atmospheric pressure ±0.5 bar and a temperature in a range of 15-25° C., and establishing a fluid-wood mixture at the fluid level having a temperature within an interval of 90-115° C., and feeding out impregnated chips from a bottom of the impregnation vessel.

2. The method according to claim 1, wherein the method further comprises withdrawing 0.1-1.5 $m^3$/ADT (Air-Dry-Tonne) impregnation fluid for recycling.

3. The method according to claim 1 wherein the method further comprises evaporating impregnation fluid into a superior bed of chips located between the fluid level and the chip level.

4. The method according to claim 1 wherein the method further comprises adding steam at a top of the impregnation vessel when a temperature of the chips is below 15-25° C.

5. The method according to claim 3 wherein the method further comprises evaporating impregnation fluid up into the superior bed of chips at a level that does not exceed half of the height of the superior bed that is above the fluid level.

6. The method according to claim 5, wherein the method further comprises evaporating the impregnation fluid up into the superior bed of chips at a level that does not exceed 25% of the height of the superior bed that is above the fluid level.

7. The method according to claim 1 wherein the method further comprises feeding the impregnation fluid at a position that is within one meter from the fluid level.

8. The method according to claim 1 wherein the method further comprises adding the impregnation fluid at a center of a cross-section the impregnation vessel.

9. The method according to claim 2, wherein the method further comprises measuring a temperature of the withdrawn impregnation fluid.

10. The method according to claim 1 wherein the method further comprises including partially consumed cooking fluid, from a subsequent digester, into the impregnation fluid.

11. The method according to claim 1 wherein the method further comprises cooling a portion of the impregnation fluid in a cooler before feeding the impregnation fluid into the impregnation vessel.

12. The method according to claim 1 wherein the method further comprises heating a portion of the impregnation fluid in a heater prior to feeding the impregnation fluid into the impregnation vessel.

* * * * *